US005600332A

United States Patent [19]

Brown et al.

[11] Patent Number: 5,600,332

[45] Date of Patent: Feb. 4, 1997

[54] WIDEBAND, LOW FREQUENCY, AIRBORNE VIVALDI ANTENNA AND DEPLOYMENT METHOD

[75] Inventors: Kenneth W. Brown, Yucaipa; Keith G. Kato, Rancho Cucamonga; David R. Sar, Placentia; Byron M. Niemeier, Claremont, all of Calif.

[73] Assignee: Hughes Missile Systems Company, Los Angeles, Calif.

[21] Appl. No.: 506,055

[22] Filed: Jul. 24, 1995

[51] Int. Cl.[6] ..... H01Q 1/30

[52] U.S. Cl. ..... 343/707; 343/740; 343/749

[58] Field of Search ..... 343/767, 707, 343/731, 735, 739, 808, 809, 740, 749; H01Q 1/28, 1/30

[56] References Cited

U.S. PATENT DOCUMENTS

| | | | |
|---|---|---|---|
| 1,418,729 | 6/1922 | Oswald | 343/707 |
| 3,829,861 | 8/1974 | Karaganis et al. | 343/707 |

*Primary Examiner*—Michael C. Wimer
*Attorney, Agent, or Firm*—Charles D. Brown; Wanda K. Denson-Low

[57] ABSTRACT

A wire antenna having a Vivaldi taper that is used to radiate or receive low frequency RF energy from or to an airborne platform. The antenna comprises two conducting wires that trail from the platform, and which comprise a radiator having a Vivaldi taper. The shape of the conducting wires is maintained by a combination of aerodynamic drag on the conducting wires, a weight connected to the end of the lower wire, a chute connected to the end of the upper wire, and nonconducting guy-wires connecting the upper and lower conducting wires. The nonconducting guy-wires are positioned at locations between the upper and lower conducting wires to form and maintain an optimal taper between the conducting wires. A method of deploying a Vivaldi antenna from an airborne platform is also disclosed. A lower conducting wire is attached to the enclosure, and an upper conducting wire is attached to a chute. The antenna and chute are stored in the enclosure, and the enclosure is disposed beneath the platform. The platform is then flies along a flight path. The antenna is partially unrolled from the spool, and the enclosure drops from beneath the platform as the antenna is unrolled. The enclosure remains attached to the lower conducting wire, allowing a feed for the antenna to remain fixed on the platform. The antenna is further unrolled so that the enclosure becomes a weight for the lower conducting wire. The upper wire is then released from the enclosure with chute attached, and the upper wire is pulled upwards by the chute to fully deploy the antenna in the desired shape.

14 Claims, 3 Drawing Sheets

10
11
12
13
14
15
16
17
18
19

WIDEBAND, LOW FREQUENCY, AIRBORNE VIVALDI ANTENNA AND DEPLOYMENT METHOD

BACKGROUND

The present invention relates generally to antennas, and more particularly, to a wideband, low frequency, airborne Vivaldi antenna and deployment method.

Several airborne systems require the transmission or reception of low frequency RF signals. Traditionally this has been accomplished by trailing a long wire from the aircraft, thus forming a monopole. The monopole suffers from relatively low gain and narrow bandwidth.

A paper by L. Marin, J. P. Castillo and K. S. H. Lee, entitled "Broad-Band Analysis of VLF/LF Aircraft Wire Antennas", IEEE Trans. Antennas Propagation, Vol. AP-26, No. 1, January 1978, pp. 141–145, discusses analysis methods for various types of airborne wire antennas, none of which resemble the present invention. A paper by E. Vollmer and J. H. Hinken, entitled "Synthesis Method for Broad-Band Tapered Wire Antennas and its Experimental Verification", IEEE Trans. Antennas Propagation, Vol. AP-37, No. 8, August 1989, pp. 959–965, discusses the design of a Vivaldi wire antennas for use at millimeter wave frequencies. This reference makes no mention of applying a wire Vivaldi antenna for low frequency usage on an airborne platform.

Accordingly, it is an objective of the present invention to provide for a wideband, low frequency, airborne Vivaldi antenna and deployment method.

SUMMARY OF THE INVENTION

To meet the above and other objectives, the present invention is for a wideband, low frequency, airborne Vivaldi antenna. More specifically, the present Vivaldi antenna comprises upper and lower conducting wires that extend from the airborne vehicle, which when extended, form a radiator having a Vivaldi taper. A weight is connected to an end of the lower wire distal from the airborne vehicle, and a chute is connected to an end of the upper wire distal from the airborne vehicle. In some applications, a chute is not necessary, and drag on the upper wire is sufficient to maintain the Vivaldi taper of the antenna. Nonconducting guy-wires are connected between the upper and lower conducting wires at predetermined locations that form and maintain an optimal Vivaldi taper between the conducting wires. The Vivaldi taper of the conducting wires is maintained by a combination of aerodynamic drag on the conducting wires, the weight, the chute, and the nonconducting guy-wires, and wherein the antenna radiates energy towards the ground relative to the airborne vehicle.

The present invention also provides for a method of deploying a Vivaldi antenna having upper and lower conducting wires from an airborne vehicle. The method comprises attaching the conducting wires to a feed that is coupled to a transmitter and/or receiver. Nonconducting guy-wires are attached to the upper and lower conducting wires. The upper conducting wire is attached to a chute, and the lower conducting wire is attached to the enclosure. The antenna, chute and guy-wires are stored in the enclosure, and the enclosure is attached beneath the airborne vehicle. The airborne vehicle is then flown along a flight path. The antenna is partially unrolled from the spool while the airborne vehicle is in flight, allowing the enclosure to drop from beneath the vehicle as the antenna is unrolled. The enclosure remains attached to the lower conducting wire, allowing the feed for the antenna to remain fixed on the airborne vehicle. The antenna is then further unrolled so that the enclosure becomes a weight for the lower conducting wire. The upper wire is then released from the enclosure with chute attached, whereupon the upper wire is pulled upwards by the chute to fully deploy the antenna.

Thus, the present invention comprises a wire antenna having a Vivaldi taper that is used to radiate or receive low frequency RF energy from or to an airborne vehicle or platform. The antenna may be configured for high gain, wideband radiation from the platform towards the ground by adjusting the shape of the Vivaldi taper. A key aspect of the present invention is the manner in which the Vivaldi taper of the relatively large wire antenna is maintained during flight. The present airborne antenna may be configured for not only high gain directed towards the ground, but relatively broad bandwidths.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
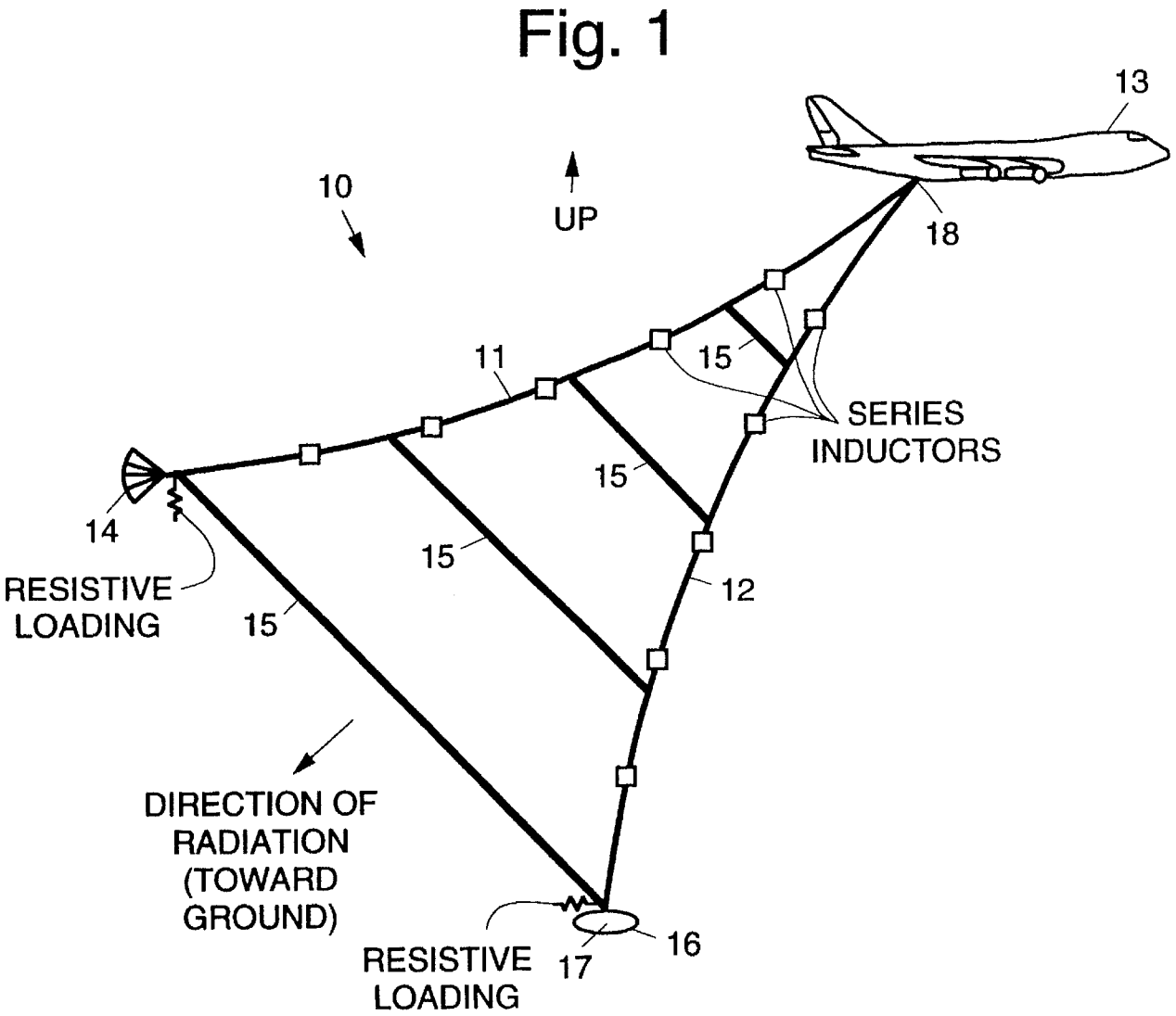
FIG. 1 a wideband, low frequency, airborne Vivaldi antenna in accordance with the principles of the present invention.
Figures 2A, 2B, 2C, 2D, 2E:
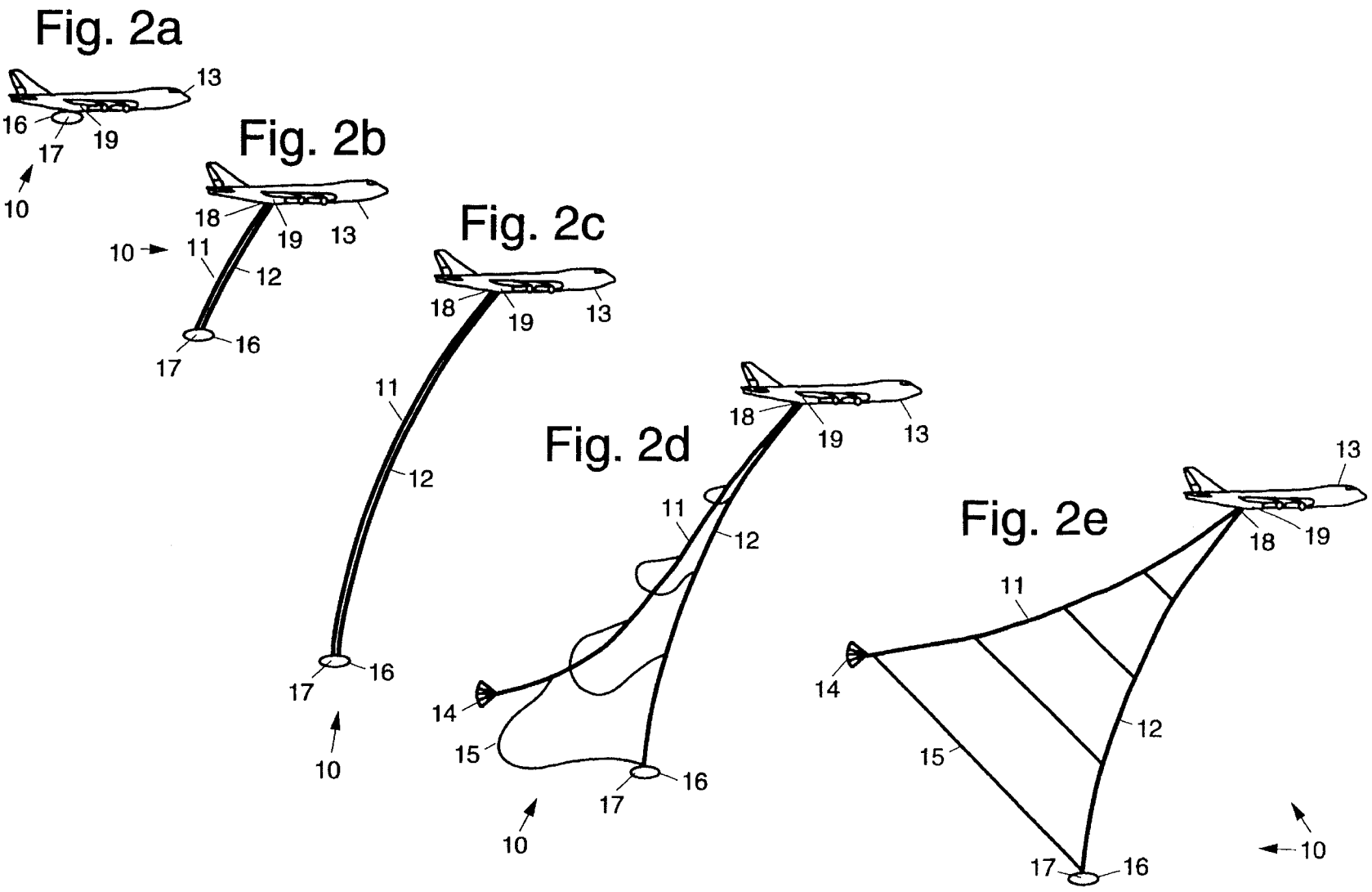
FIGS. 2*a*–2*e* illustrate deployment of the for the airborne Vivaldi antenna of FIG. 1.

Referring to the drawing figures, FIG. 1 a wideband, low frequency, airborne Vivaldi antenna 10 in accordance with the present invention. The antenna 10 comprises upper and lower conducting wires 11, 12 that trail or extend from an airborne platform 13 such as an aircraft, unmanned airborne vehicle, or helicopter, for example, and which comprise a radiator having a Vivaldi taper.

The shape of the conducting wires 11, 12 is maintained by a combination of aerodynamic drag on the conducting wires 11, 12, a weight 16 connected to the end of the lower wire 12, and in some applications, a small chute 14 connected to the end of the upper wire 11, and nonconducting guy-wires 15 connecting the upper and lower conducting wires 11, 12. In applications that do not require the chute, drag on the upper wire is sufficient to maintain the Vivaldi taper of the antenna.

The weight 16 may be an enclosure 16 or pod 16 in which the antenna 10 is stored prior to deployment. The enclosure 16 or pod 16 has a spool 17 inside of it around which the conductive wires 11, 12 and nonconducting guy-wires 15 are wound. A feed 18 that is coupled to the conducting wires 11, 12 of the antenna 10 is fixed to the airborne platform 13. The feed 18 is coupled to a transmitter and/or receiver 19 disposed in the platform 13.

The nonconducting guy-wires 15 are positioned at strategic locations between the upper and lower conducting wires 11, 12 in order to form and maintain an optimal taper between the conducting wires 11, 12. When configured as shown in FIG. 1, the antenna 10 radiates energy towards the ground. The gain of the antenna 10 depends on the radiated frequency and the length of the wires 11, 12, as well as the shape of the taper.

The conducting wires 11, 12 may be made from braided stainless steel to provide for strength, that are clad with copper to provide for enhanced electrical conductivity. This allows relatively light weight wires 11, 12 to be used, although for some applications, braided copper wire is sufficient. The wires 11, 12 may be resistively loaded at their ends to reduce scattered spherical radiation at those locations, which helps to maintain the fidelity of a radiated broadband waveform. Also, in order to maintain semi-constant electrical length wires 11, 12 as a function of frequency, which helps to maintain constant gain as a function of frequency, the conducting wires 11, 12 may be loaded with series inductors along the length of the wires 11, 12, or the diameter of the respective wires 11, 12 may be adjusted such that the inductance of the wires 11, 12 serve the same purpose. This also helps maintain the fidelity of a broadband radiated waveform.

FIGS. 2*a*–2*e* illustrate, in pictorial form, a method 20 of deploying the antenna 10 from the airborne platform 13. The wire Vivaldi antenna 10 is stored in a pod 16 or other enclosure 16 beneath the platform 13. The antenna 10 may be rolled up on a spool 17 inside a pod 16, for example. The upper conducting wire 11 is attached to a chute 14 in this embodiment. The lower conducting wire 12 is attached to the enclosure 16. The antenna 10 and chute 14 are stored in the pod 16. The airborne platform 13 is then flown along a designated flight path.

At the start of deployment, the antenna 10 is partially unrolled from the spool 17 while the airborne platform 13 is in flight, allowing the pod 16 to drop as it is unrolled. The enclosure 16 remains attached to the lower conducting wire 12, allowing the feed 18 for the antenna 10 to remain fixed on the airborne platform 13. This allows the feed 18 to remain fixed on the aircraft and be undisturbed during the deployment process. The antenna 10 is unrolled completely, and the pod 16 becomes a weight 16 for the lower conducting wire. The upper wire, with chute 14 attached, is released from the pod 16 and the upper wire is pulled upwards by the chute 14 to fully deploy the antenna 10.

The present Vivaldi-tapered wire antenna 10 is used to radiate or receive low frequency RF energy from or to an airborne vehicle or platform 13. The antenna 10 may be configured for high gain, wideband radiation from the platform 13 towards the ground by adjusting the shape of the Vivaldi taper.

The present invention allow the use of a reduced complexity transmitter/receiver in the aircraft, because the antenna 10 has higher gain than prior art antennas used for similar purposes. The present invention has commercial uses that include use as a high gain receive antenna for picking up low power ground transmissions such as aircraft "black boxes" and lost hikers, and the like.

Figure 3:
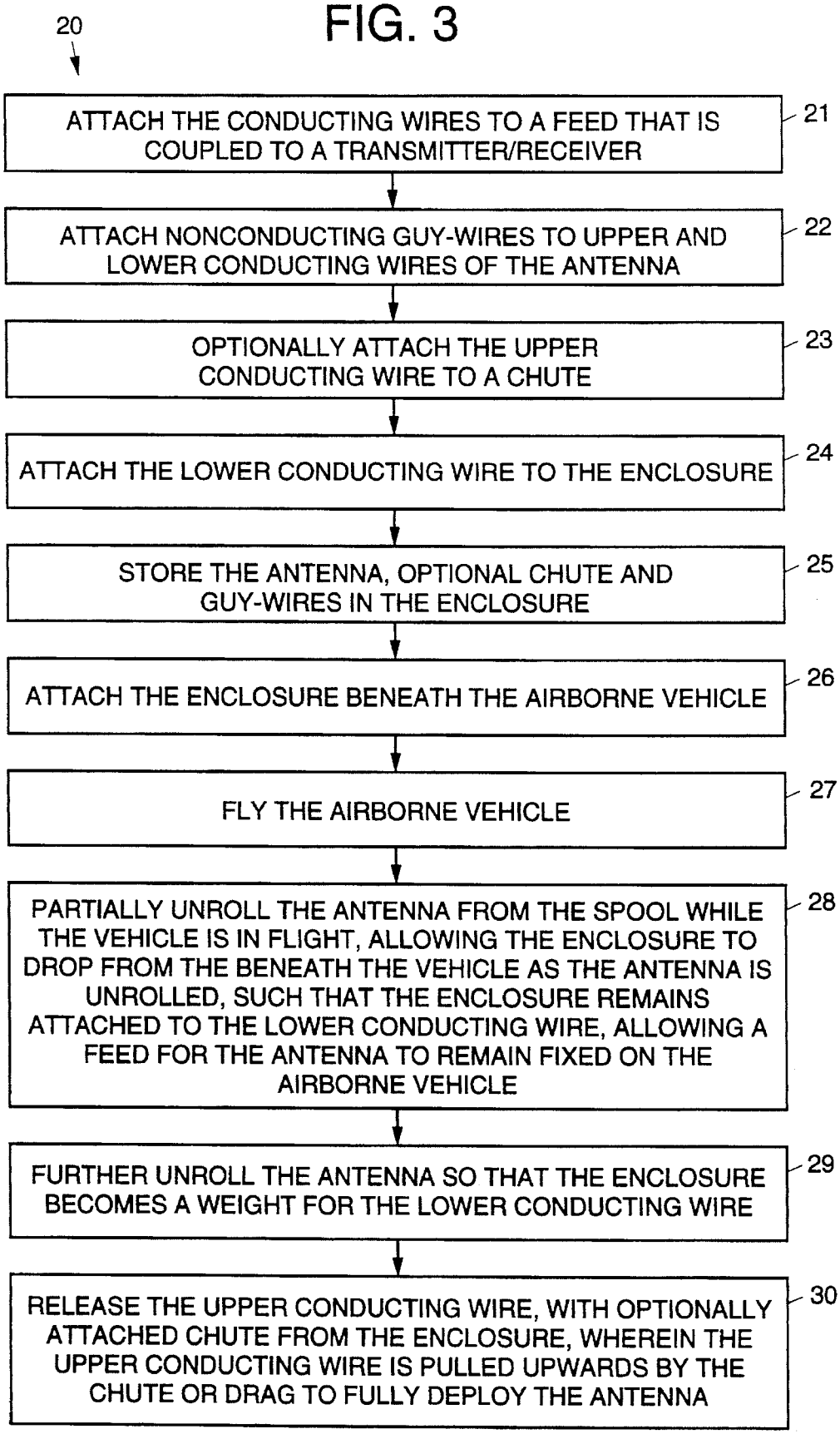
FIG. 3 is a flow chart illustrating the method of deploying a Vivaldi antenna from an airborne vehicle in accordance with the principles of the present invention.

For the purposes of completeness, FIG. 3 is a flow chart illustrating the method 20 of deploying a Vivaldi antenna having upper and lower conducting wires 11, 12 from an airborne vehicle 13 in accordance with the principles of the present invention. The method 20 comprises the following steps. The conducting wires 11, 12 are attached 21 to a feed 18 that is coupled to a transmitter/receiver 19. Nonconducting guy-wires 15 are attached 22 to the upper and lower conducting wires 11, 12. The upper conducting wire 11 is optionally attached 23 to the chute 14, and the lower conducting wire 12 is attached 24 to enclosure 16. The antenna 10, optional chute 14 and guy-wires 15 are stored 25 in the enclosure 16, and the enclosure is attached 26 beneath the airborne vehicle. The airborne vehicle 13 then flown 27.

The antenna 10 is partially unrolled 28 from the spool 17 while the vehicle 13 is in flight, allowing the enclosure 16 to drop from the beneath the vehicle 13 as the antenna 10 is unrolled, such that the enclosure 16 remains attached to the lower conducting wire 12, allowing the feed for the antenna 10 to remain fixed on the vehicle 13. The antenna 10 is further unrolled 29 so that the enclosure 16 becomes a weight 16 for the lower conducting wire 12. The upper conducting wire 11, with or without the attached chute 14 is released 30 from the enclosure 16, and is pulled upwards by the chute 14, or by drag of the upper conducting wire 11, to fully deploy the antenna 10.

Thus, a wideband, low frequency, airborne Vivaldi antenna and deployment method have been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A wideband, low frequency, airborne Vivaldi antenna for use with an airborne vehicle, said antenna comprising:

upper and lower conducting wires that extend from a moving airborne vehicle, which when extended, form a radiator having a Vivaldi taper;

a weight connected to an end of the lower wire distal from the airborne vehicle; and nonconducting guy-wires connected between the upper and lower conducting wires at predetermined locations that form and maintain an optimal Vivaldi taper between the conducting wires;

and wherein the Vivaldi taper of the conducting wires is maintained by a combination of aerodynamic drag on the conducting wires, the weight, and the nonconducting guy-wires, and wherein the antenna radiates energy towards the ground relative to the airborne vehicle.

2. The antenna of claim 1 further comprising:

a chute connected to an end of the upper wire distal from the airborne vehicle;

and wherein the Vivaldi taper of the conducting wires is maintained by a combination of aerodynamic drag on the conducting wires, the weight, the chute, and the nonconducting guy-wires, and wherein the antenna radiates energy towards the ground relative to the airborne vehicle.

3. The antenna of claim 1 wherein the gain of the antenna is a function of the frequency radiated by the antenna, the length of the wires, and the shape of the taper.

4. The antenna of claim 1 wherein the conducting wires are made of braided stainless steel.

5. The antenna of claim 1 wherein the conducting wires are made of braided stainless steel clad with copper.

6. The antenna of claim 1 wherein the conducting wires are made of braided copper.

7. The antenna of claim 1 wherein the wires are resistively loaded at their ends to reduce scattered spherical radiation at those locations to maintain the fidelity of its radiated broadband waveform.

8. The antenna of claim 1 wherein the conducting wires are loaded with series inductors along their length to provide for semi-constant electrical length wires as a function of frequency.

9. The antenna of claim 1 wherein the diameters of the conducting wires increase along their lengths to provide for semi-constant electrical length wires as a function of frequency.

10. A method of deploying a Vivaldi antenna having upper and lower conducting wires from an airborne vehicle, comprising the steps of:

attaching the upper and lower conducting wires to a feed that is coupled to a transmitter/receiver;

attaching nonconducting guy-wires to the upper and lower conducting wires;

attaching the lower conducting wire to an enclosure;

storing the antenna in the enclosure;

attaching the enclosure beneath the airborne vehicle;

flying the airborne vehicle;

partially unrolling the antenna from the vehicle while the vehicle is in flight, allowing the enclosure to drop from the beneath the vehicle as the antenna is unrolled, such that the enclosure remains attached to the lower conducting wire, allowing the feed for the antenna to remain fixed on the airborne vehicle;

further unrolling the antenna so that the enclosure becomes a weight for the lower conducting wire; and releasing the upper conducting wire from the enclosure, wherein the upper conducting wire is pulled upwards by drag thereon to fully deploy the antenna.

11. The method of claim 10 further comprising the step of:

attaching the upper conducting wire to a chute;

and wherein releasing the upper conducting wire with attached chute from the enclosure causes the upper conducting wire to be pulled upwards by the chute to fully deploy the antenna.

12. The method of claim 10 further comprising the step of:

resistively loading the wires at their ends to reduce scattered spherical radiation at those locations to maintain the fidelity of the broadband waveform radiated by the antenna.

13. The method of claim 10 further comprising the step of:

loading the conducting wires with series inductors along their length to provide for semi-constant electrical length wires as a function of frequency.

14. The method of claim 10 further comprising the step of:

adjusting the diameters of the conducting wires such that the inductance of the wires provide for semi-constant electrical length wires as a function of frequency.

* * * * *